US009820550B2

(12) United States Patent
Heraud

(10) Patent No.: US 9,820,550 B2
(45) Date of Patent: Nov. 21, 2017

(54) SYSTEM FOR HOLDING A COSMETIC PRODUCT IN THE FORM OF A STICK OF MATERIAL, CASING PROVIDED WITH SUCH A HOLDING SYSTEM AND ASSEMBLY METHOD

(71) Applicant: AXILONE PLASTIQUE, Auray (FR)

(72) Inventor: Anthony Heraud, Mamaroneck, NY (US)

(73) Assignee: AXILONE PLASTIQUE, Auray (FR)

( * ) Notice: Subject to any disclaimer, the term of this patent is extended or adjusted under 35 U.S.C. 154(b) by 5 days.

(21) Appl. No.: 14/908,008

(22) PCT Filed: Jul. 18, 2014

(86) PCT No.: PCT/FR2014/051850
§ 371 (c)(1),
(2) Date: Jan. 27, 2016

(87) PCT Pub. No.: WO2015/011379
PCT Pub. Date: Jan. 29, 2015

(65) Prior Publication Data

US 2016/0183662 A1 Jun. 30, 2016

(30) Foreign Application Priority Data

Jul. 26, 2013 (FR) ..... 13 57432

(51) Int. Cl.
*A45D 40/12* (2006.01)
*A45D 40/02* (2006.01)
(Continued)

(52) U.S. Cl.
CPC ..... *A45D 40/12* (2013.01); *A45D 40/02* (2013.01); *A45D 40/04* (2013.01); *A45D 40/06* (2013.01)

(58) Field of Classification Search
CPC combination set(s) only.
See application file for complete search history.

(56) References Cited

U.S. PATENT DOCUMENTS 1,646,005 A 10/1927 Gaston
5,096,318 A 3/1992 Susini et al.
(Continued)

FOREIGN PATENT DOCUMENTS

DE 199 39 934 A1 4/2001
EP 0 439 381 A1 7/1991
(Continued)

OTHER PUBLICATIONS

International Search Report, dated Sep. 1, 2014, from corresponding PCT application.

*Primary Examiner* — David Walczak
(74) *Attorney, Agent, or Firm* — Young & Thompson

(57) ABSTRACT

A system for holding a stick in a casing includes an inner cup provided with a plurality of at least partially flexible claws that can assume two positions:—an open position, in which the claws allow the stick to be inserted into the inner cup;—a blocked position in which the claws can penetrate into the stick previously inserted into the inner cup in order to block it; the system further including an outer cup of which the dimensions are designed to allow the claws to shift from the open position to the closed position, and elements for locking the inner cup in the outer cup when the claws are in the blocked position.

22 Claims, 16 Drawing Sheets

(51) Int. Cl.
*A45D 40/04* (2006.01)
*A45D 40/06* (2006.01)

(56) References Cited

U.S. PATENT DOCUMENTS

| | | | | | |
|---|---|---|---|---|---|
| 5,865,550 | A * | 2/1999 | Bouix | A45D 40/06 401/78 |
| 5,871,295 | A | 2/1999 | Bouix | |
| 6,116,801 | A * | 9/2000 | Patel | A45D 40/06 401/78 |
| 6,231,254 | B1 * | 5/2001 | Holloway | A45D 40/04 132/318 |
| 6,244,770 | B1 | 6/2001 | Holloway | |
| 2006/0222440 | A1 * | 10/2006 | Bauer | B43K 21/08 401/88 |

FOREIGN PATENT DOCUMENTS

| | | |
|---|---|---|
| EP | 0 989 812 B1 | 4/2000 |
| EP | 0 995 367 A2 | 4/2000 |
| EP | 1 098 577 B1 | 5/2001 |

* cited by examiner

SYSTEM FOR HOLDING A COSMETIC PRODUCT IN THE FORM OF A STICK OF MATERIAL, CASING PROVIDED WITH SUCH A HOLDING SYSTEM AND ASSEMBLY METHOD

The invention relates to the field of casings for cosmetic products that come in the form of a stick, such as lipstick.

More specifically, the invention relates to a system for retaining the stick of material in the casing.

SUMMARY OF THE INVENTION

A stick of lipstick is generally placed on a support slidably mounted in a casing, and an actuation mechanism allows controlling the sliding. In general, the actuation mechanism consists of a pivoting part, accessible on a lower portion of the casing, in helical connection with the support, such that rotation of the pivoting part, actuated by the user, causes the support to slide in an axial direction within the casing. The stick can thus be extended outside the casing for application, or be retracted into the casing in order to protect and store it.

The stick is preferably attached to the support, to prevent it from unintentionally escaping from the support and casing. It is known to retain the stick on its support, for example by impaling. For this purpose, the support is provided with two pointed tabs extending axially which impale the material of the stick when it is inserted on the support.

However, such a solution is not satisfactory. Depending on the formulation and on the temperature, the hardness of the stick may be insufficient for such retention by impaling to always be effective. In particular, the current trend is toward soft formulations, for which impalement does not properly hold the stick.

In document EP 1098577, it is proposed to combine retention by impalement with resilient arms on the support, these arms not extending parallel to the axial direction.

The stick is cooled beforehand to harden it and is then inserted into a housing formed by the support, comprising a bottom and a side surface. Pointed tabs for the impalement project from the bottom of the housing, while the resilient arms are placed on the side wall. The arms are pushed out of the housing when the cooled and hardened stick is inserted into the housing. Then as the stick warms and softens, the resilient arms return to their initial position and penetrate the stick, retaining it axially.

However, such a solution involves subjecting the stick to temperature variations, which can be detrimental to the quality of the cosmetic product.

It has therefore been proposed to implement claws on the support which are forced into the stick when the support is inserted into the case of the cosmetic packaging, preventing all axial movement.

Document U.S. Pat. No. 5,871,295 proposes implementing a plate-shaped support, provided on its edge with projecting arms between which the stick can be installed. The support is then pushed into a housing whose inner wall forms a cam for the arms. The arms slide along the wall and are deformed to penetrate the stick.

However, the thrust force exerted on the support is passed on to the stick by the arms. During insertion of the support into the housing, the stick may then be pushed in an axial direction which can cause it to extend out of the support, where the arms cannot penetrate the stick and the locking is absent.

Document EP 0 995 367 discloses a cup forming a support for a stick of lipstick. The cup is provided with claws on the edge of the opening through which the stick is inserted into the cup. When the cup is inserted into the casing, the claws fold into the stick.

This embodiment allows exerting force, via the claws, in the axial direction which tends to retain the stick against the bottom of the support, in the housing. However, it has the disadvantage of not locking the stick when the support is at the end of the casing, meaning when the user has extended the stick as far as possible from the casing. Indeed, as the claws are flexible, if they are extended out of the casing, they could return to their original position out of the stick, which is then free to detach from the support.

SUMMARY OF THE INVENTION

For casings of cosmetic products in stick form, the invention aims to propose a solution to these problems of the state of the art.

More particularly, the invention provides a support forming a retaining system for effectively locking a stick material, such as a stick of lipstick, on the support.

In a first aspect, the invention provides a system for retaining a cosmetic product in the form of a stick of material, in particular a stick of lipstick, in a casing, holding the stick in the provided housing in an effective manner, even for soft compositions.

In a second aspect, the invention provides a system for retaining in particular a stick of lipstick in a casing, which reduces the risk of releasing the stick.

In a third aspect, the invention provides a system for retaining in particular a stick of lipstick in a casing, which is inexpensive.

In a fourth aspect, the invention provides a system for retaining in particular a stick of lipstick in a casing, which is adaptable to existing casings available on the market and which can replace retaining systems already in place in a casing.

A description of the invention as characterized in the claims is provided below.

According to a first aspect, the invention relates to a system for retaining a cosmetic product in the form of a stick of material, in particular a stick of lipstick, in a casing, the system comprising an inner cup forming a housing for the stick, the inner cup comprising an opening through which the stick can be inserted, the edge of the opening being provided with a plurality of at least partially flexible claws, arranged in a crown extending between a proximal boundary edge, of dimensions greater than or equal to the dimensions of the edge of the opening, and a distal boundary edge.

The claws can then take two positions:

- an open position, in which the dimensions of the distal boundary edge are greater than or equal to the dimensions of the edge of the opening, the claws allowing insertion of the stick into the inner cup;
- a locking position, in which the dimensions of the distal boundary edge are less than the dimensions of the edge of the opening, the claws being able to penetrate into the stick previously inserted into the inner cup in order to lock the stick.

The system further comprises an outer cup, adapted to be slidably mounted in the casing, and forming a sleeve for the inner cup, the sleeve dimensions being adapted to allow the crown of claws to shift from the open position to the closed position by insertion of the inner cup into the outer cup. It also comprises elements for locking the inner cup in the outer cup when the claws are in the locking position.

Thus, due to the locking between the two cups, the claws cannot shift to the open position when this is not desired.

According to a first embodiment, the outer cup may comprise, on the outer surface of a side wall, at least one lug adapted to be in helical connection with the casing, so as to guide the sliding of the outer cup in the casing.

According to a second embodiment, the outer cup comprises, on its bottom, a guide rod provided with at least one fin adapted to be in helical connection with the casing.

The retaining system can thus be adapted to any type of guidance in the casing.

The locking elements may comprise at least one tab projecting from the outer surface of the bottom of the inner cup and at least one hole in the bottom of the outer cup, the tab and hole snap-fitting together to lock the inner cup in the outer cup when the crown of claws is in the locking position.

This embodiment of the locking elements is particularly suitable for use with the first embodiment of guidance in the casing.

Alternatively, the locking elements may comprise at least one bead projecting from an inner surface of a side wall of the outer cup and at least one recess in an outer surface of a side wall of the inner cup, the bead and recess snap-fitting together to lock the inner cup in the outer cup when the claws are in the locking position.

This alternative embodiment of the locking elements is particularly suitable for use with the second embodiment of guidance in the casing.

Advantageously, the claws may each have an inner side facing the housing for the stick, the inner side of the claws being provided with teeth, increasing the retaining force exerted on the stick.

The claws are preferably identical to one another and are four to ten in number, for example eight, uniformly distributed around the opening of the inner cup. It has been determined that in this configuration, the retaining force on the stick is optimal and is substantially equally distributed across the cross-section of the stick at the height where the claws penetrate the stick in the locking position.

According to a second aspect, the invention relates to a casing of a stick of material for a cosmetic product, provided with a retaining system as presented above, the outer cup cooperating in translation with the casing so as to cause the stick to extend from the casing or retract into the casing.

According to a third aspect, the invention relates to a method for assembling a stick of material for a cosmetic product in the casing presented above, comprising the following operations:

- insertion of the outer cup into the casing,
- insertion of the inner cup into the outer cup, the claws being in the open position,
- insertion of the stick into the housing of the inner cup,
- application of force on the stick so as to force the crown of claws of the inner cup into the outer cup, the claws coming into the locking position,
- engaging the locking elements between the inner cup and outer cup.

BRIEF DESCRIPTION OF THE DRAWINGS

The figures in the drawings are now briefly described.

DETAILED DESCRIPTION

Figure 1:
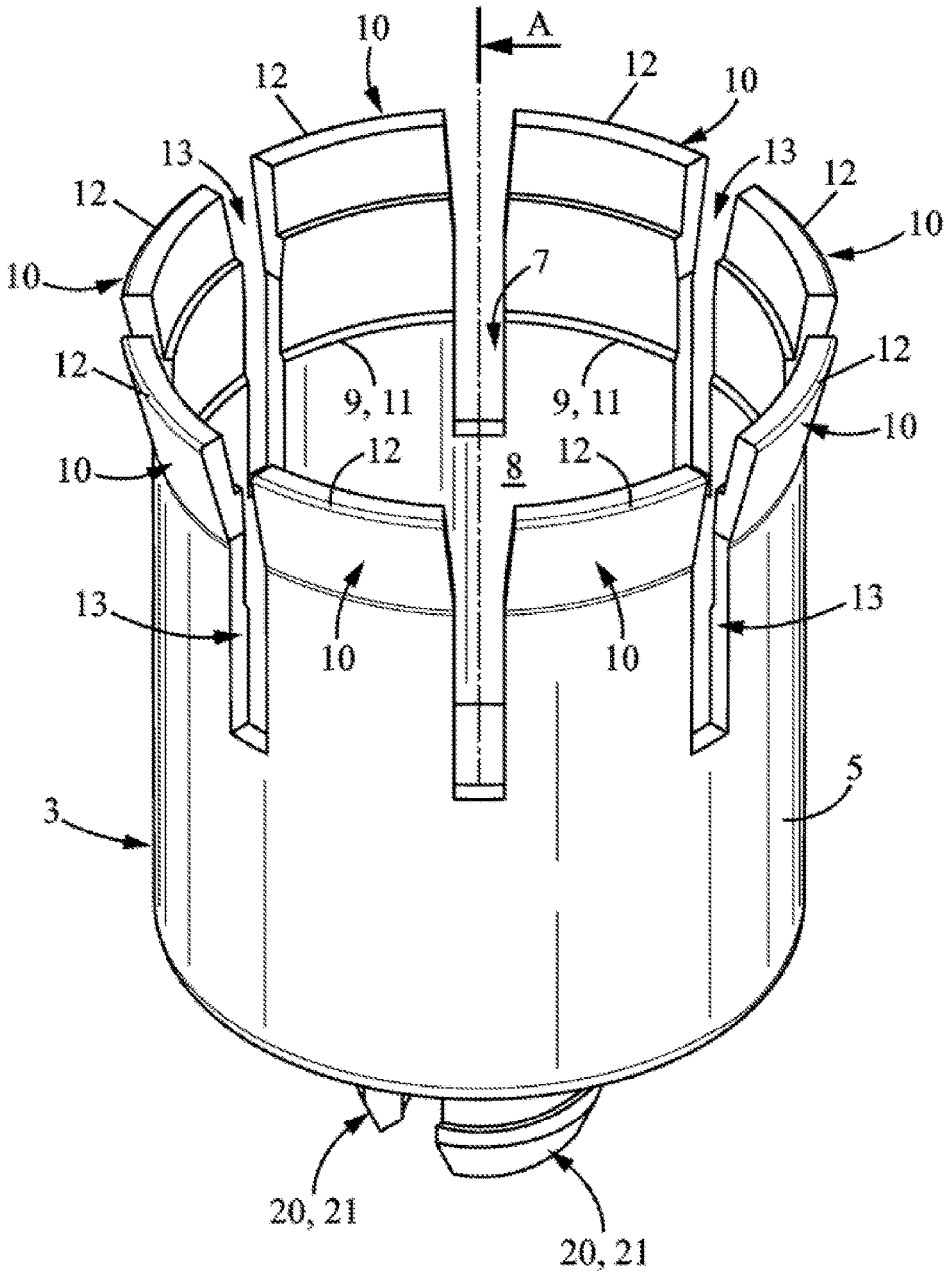
FIG. 1 is a perspective view of a so-called "inner" cup of a system for retaining a cosmetic product in the form of a stick of material, in particular a stick of lipstick, in a casing, the cup comprising claws in an open position.

Below is a detailed account of several embodiments of the invention, accompanied by examples and with reference to the drawings.

In FIGS. 1 to 9 are illustrated the parts of a system 1 for retaining a cosmetic product in the form of a stick 2 of material, in a casing. The cosmetic product is a stick of lipstick, for example.

The retaining system 1 comprises a so-called "inner" cup 3 and a so-called "outer" cup 4.

The inner cup 3 comprises a side wall 5, advantageously, as will be seen below, cylindrical and symmetrical about a longitudinal axis A, closed at one end by a bottom 6 and forming an opening 7 at the other end. The inner cup 3 thereby forms a housing 8 between its side wall 5 and the bottom 6, for the stick 2 which can be inserted into the housing 8 through the opening 7.

The opening 7 is delimited by an edge 9, the dimensions of which are adapted to allow insertion of the stick 2 into the housing 8. The edge 9 of the opening 7 is provided with a plurality of claws 10 arranged in a crown.

"Claw" is understood to mean any element or roughness projecting from the edge 9 of the opening 7 towards the exterior of the opening 8, regardless of the shape, capable of penetrating into the stick 2 when a specific force is applied.

The crown of claws 10 extends between a proximal boundary edge and a distal boundary edge, meaning that when the inner cup 3 is viewed in a plane perpendicular to the longitudinal axis A, the claws 10 are between the proximal boundary edge and the distal boundary edge. The dimensions of the proximal boundary edge are greater than or equal to the dimensions of the edge 9 of the opening 7.

More specifically, each claw comprises a proximal end 11 fixed to the edge 9 of the opening and a free distal end 12. Thus, in practice, as the inner cup 3 forms a right circular cylinder, the proximal boundary edge is a circle passing through the proximal ends 11 of each claw 10 and the distal boundary edge is also a circle passing through the distal ends 12 of each claw 10, meaning that the proximal boundary edge coincides with the edge 9 of the opening 7 of the inner cup 3. A slot 13 is formed between each claw 10.

The claws 10 are at least partially flexible, meaning that they comprise at least one flexible portion allowing them to be hinged relative to the edge 9 of the opening 7.

"Flexible" is understood to mean that a claw can be deformed, elastically or plastically, without breaking under the action of a stress exerted manually by an operator.

For example, the claws are flexible in at least a portion extending from the proximal end 11, and can be harder as the distal end 12 is approached. The slots 13 may extend beyond the claws 10, into the side wall 5 of the inner cup 3, in particular in order to increase the flexibility of the claws 10.

To facilitate production, the claws 10 are identical to one another. There are, for example, between four and ten, uniformly distributed around the opening 7 of the inner cup 3. For example, the retaining system 1 comprises eight claws.

Thus, due to their flexibility, the crown of claws 10 can take two positions:

- an open position, in which the dimensions of the distal boundary edge are greater than the dimensions of the edge 9 of the opening 7, the claws 10 allowing insertion of the stick 2 into the inner cup 3 through the opening 7;
- a locking position, in which the dimensions of the distal boundary edge are less than the dimensions of the edge 9 of the opening 7, the claws 10 being able to penetrate into the stick 2 previously inserted into the inner cup 3 in order to lock the stick.

More precisely, in the example of the figures, in the open position, the proximal boundary edge being coincident with the edge 9 of the opening, in the open position, the claws 10 are completely out of the housing 8, allowing access for insertion of the stick 2 into the housing 8 of the inner cup 3. In other words, the claws 10 in the open position flare outward from the housing 8. Then, in the locking position, the claws comprise at least one portion extending into the housing 8. When the stick 2 has been previously inserted into the housing 8 of the inner cup 3 with the claws 10 in the open position, the claws brought into locking position bite into the stick 2, retaining it in the housing 8.

The claws 10 each have an inner side directed towards the housing 8 for the stick 2. In order to increase the grip of the claws 10 in the stick 2, the inner surface of the claws 10 may be provided with teeth 14, each tooth 14 forming a ridge 15 projecting toward the inside of the housing 8. Each claw 10 may comprise one or more teeth 14, as represented in particular in FIGS. 5*a* to 5*d*. The ridges of the teeth 15 are then substantially parallel to one another and extend in a plane perpendicular to the longitudinal axis A.

The outer cup 4 then allows deforming the claws 10, due to their flexibility, and moving the claws 10 from the open position to the locking position. To this end, the outer cup 4 forms a sleeve for the inner cup 3, meaning that the dimensions of the outer cup 4 allow inserting the inner cup 3. More specifically, the outer cup 4 also comprises a cylindrical side wall 16 symmetrical about a longitudinal axis B, whose inner diameter is substantially equal to the outer diameter of the side wall 5 of the inner cup 3. The side wall 16 of the outer cup 4 is closed at one end by a bottom 17 and forms an opening 18 at the other end.

By inserting the inner cup 3 into the outer cup 4 such that the longitudinal axis A of the inner cup 3 is coincident with the longitudinal axis B of the outer cup 4, the claws 10 of the inner cup 3 in their open position abut against the edge 19 of the opening 18 of the outer cup 4. By applying a force along the longitudinal axis A, the claws are forced to flex towards the inside of the housing 8 in order to shift into the locking position. The slots 13 are dimensioned so that in the locking position, the claws 10 do not overlap. Advantageously, in the locking position, the claws 10 are in contact with their neighbors, forming a closed surface.

The retaining system 1 further comprises elements 20 for locking the inner cup 3 in the outer cup 4 when the claws 10 are in the locking position. These locking elements 20 prevent all movement between the inner cup 3 and outer cup 4, at least along the longitudinal axis A.

Figure 2:
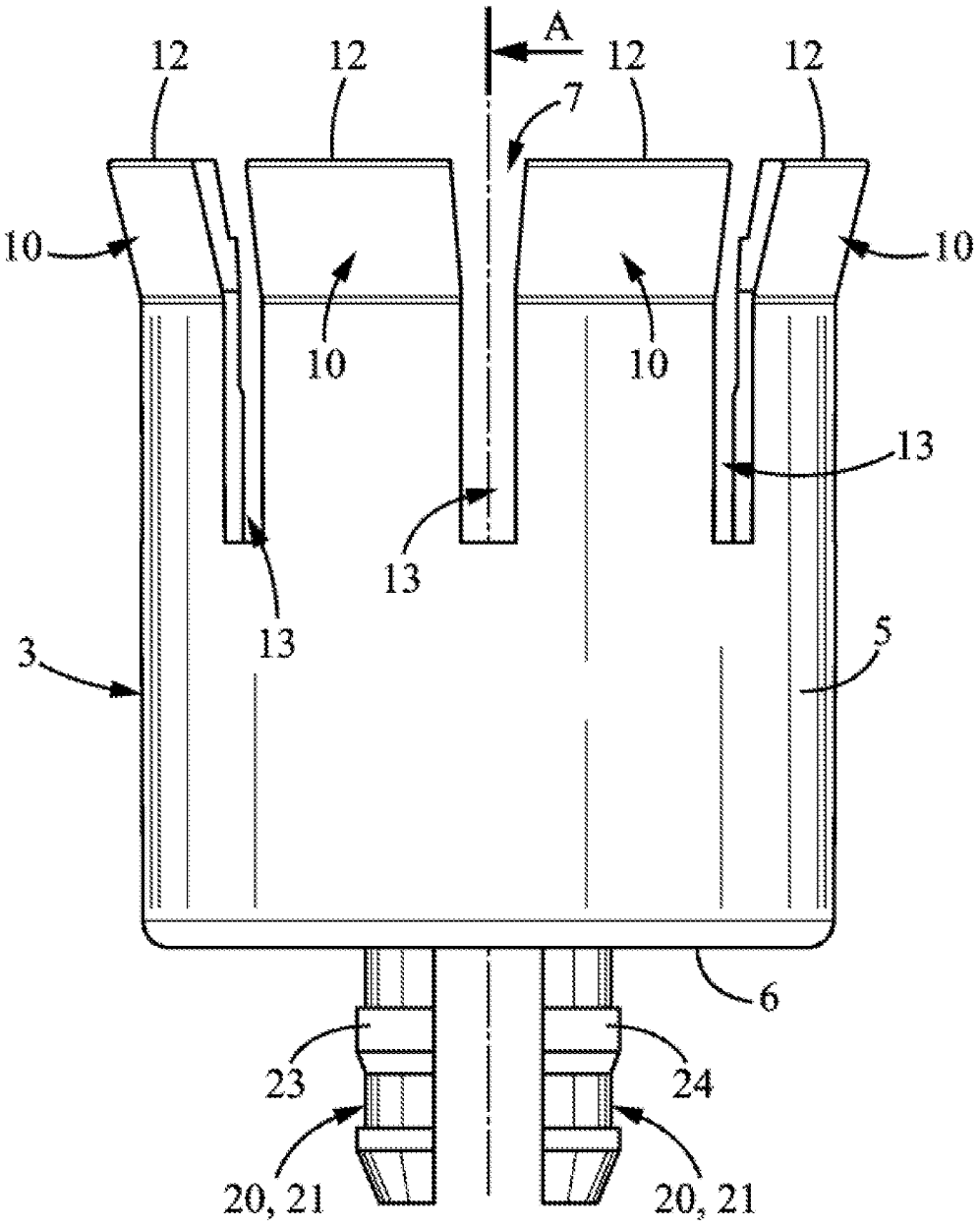
FIG. 2 is a side view of the inner cup of FIG. 1.
Figure 3:
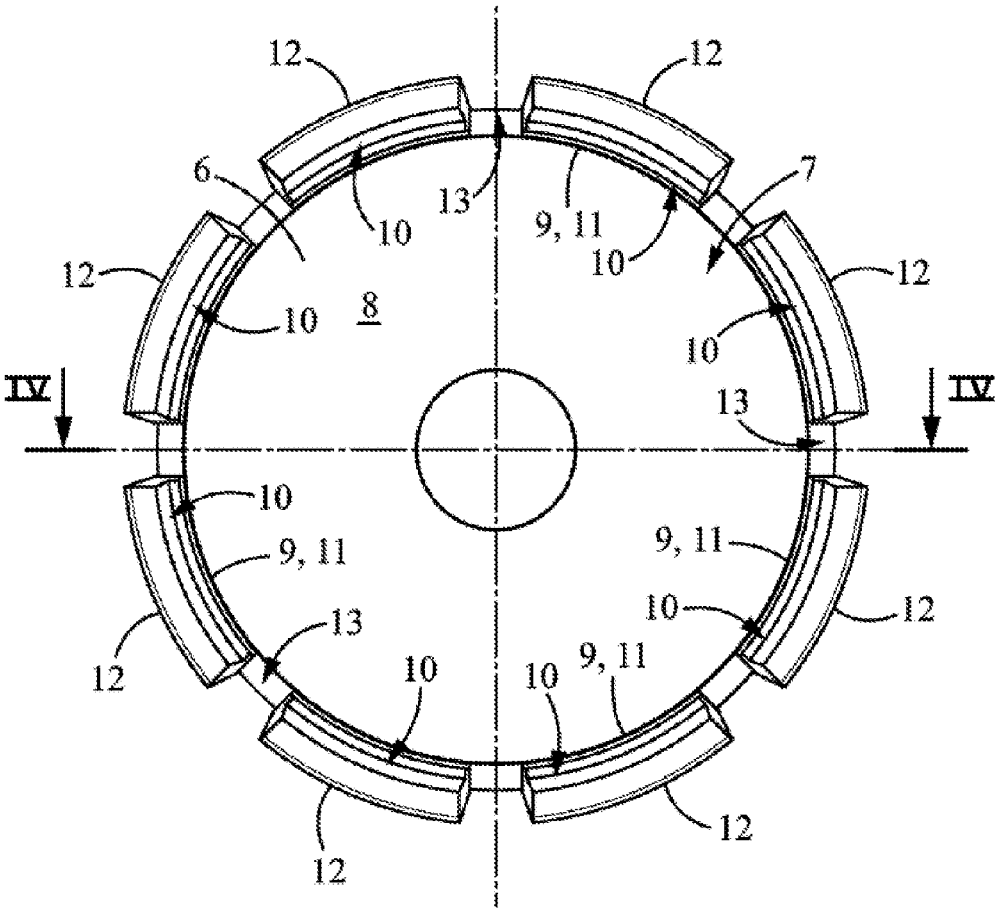
FIG. 3 is a top view of the inner cup of FIGS. 1 and 2.
Figure 4:
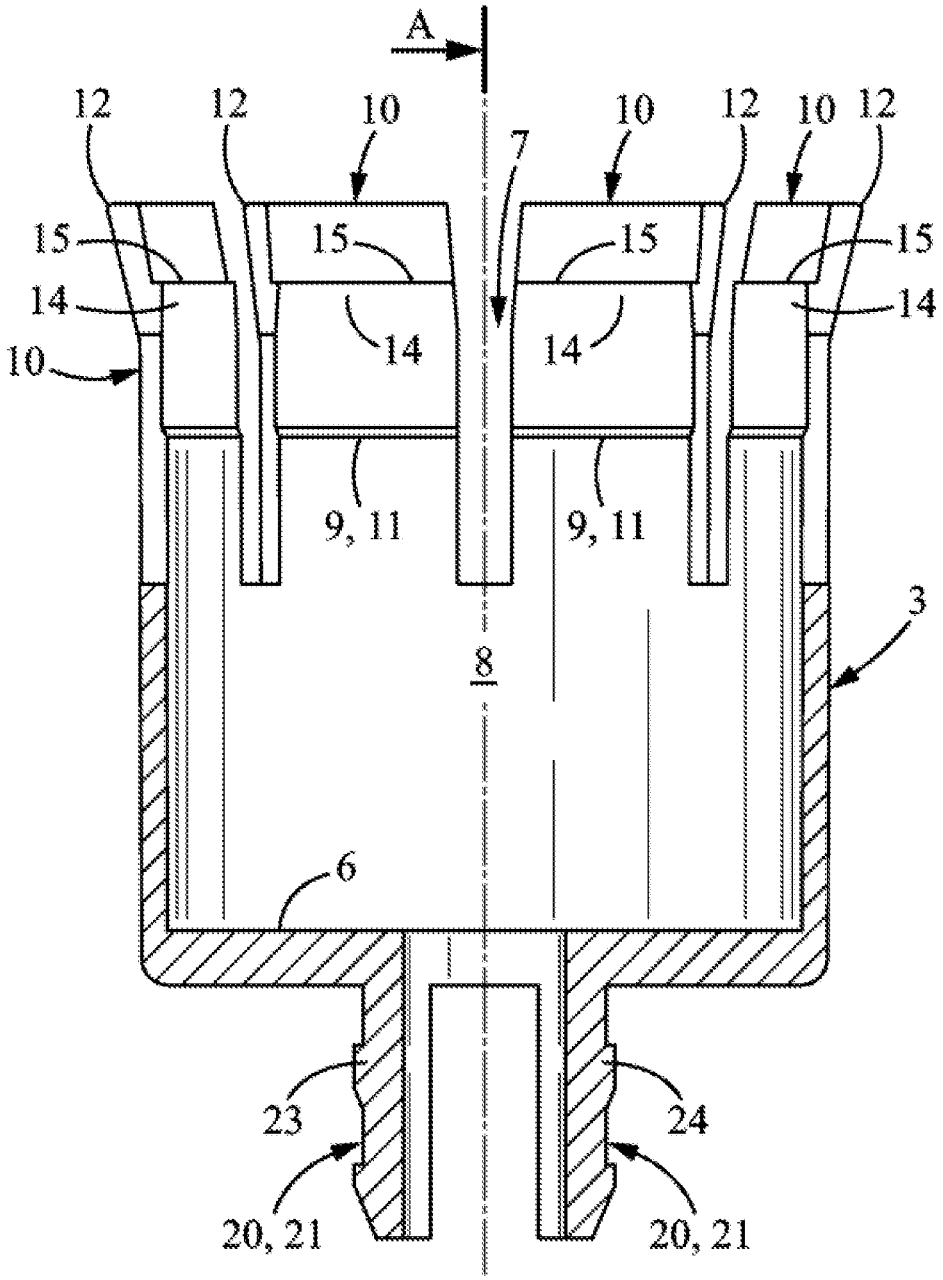
FIG. 4 is a sectional view along line IV-IV of the inner cup of FIG. 3.
Figure 5A:
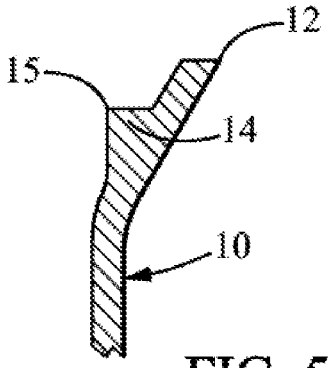
FIGS. 5*a* to 5*d* each show an alternative embodiment of the claws of the inner cup.
Figure 5B:
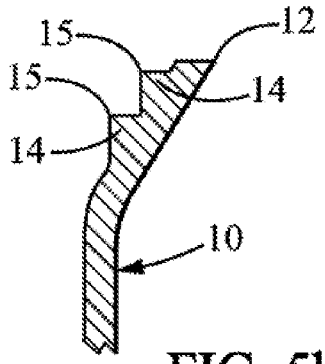
Figure 5C:
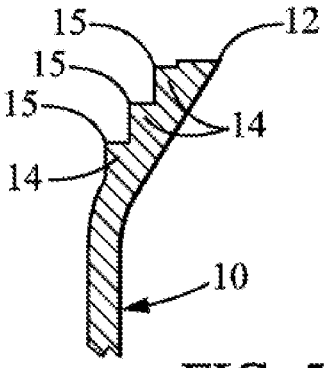
Figure 5D:
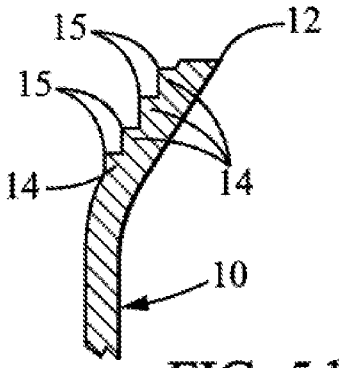
Figure 6:
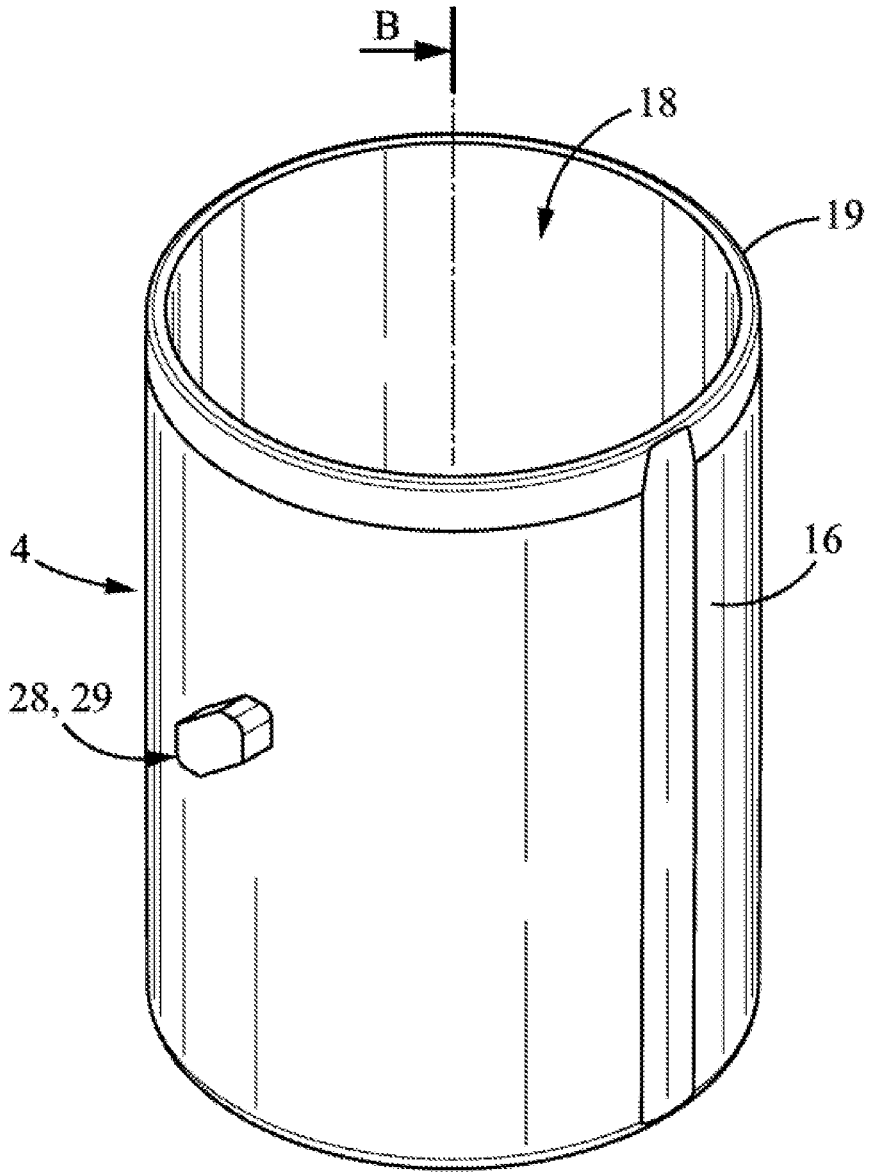
FIG. 6 is a perspective view of a so-called "outer" cup of the retaining system.
Figure 7:
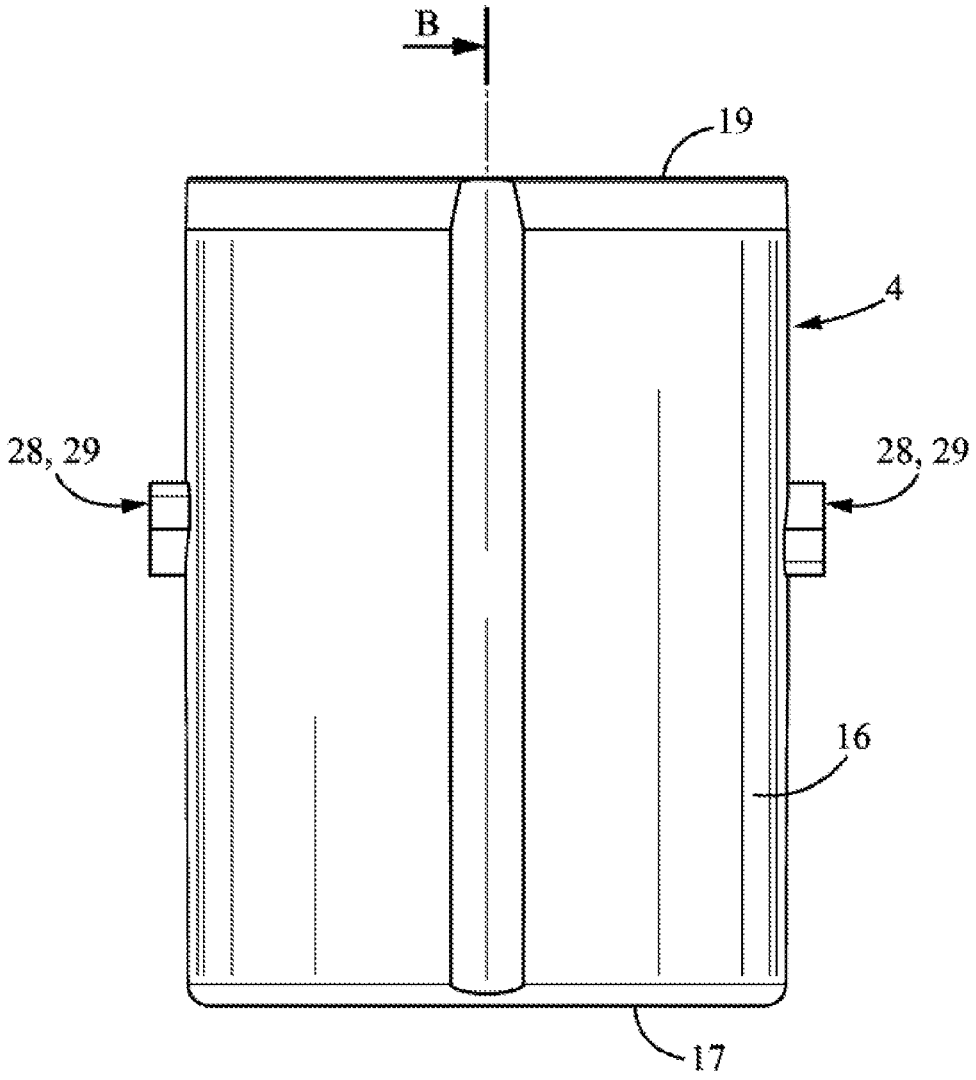
FIG. 7 is a side view of the outer cup of FIG. 6.
Figure 8:
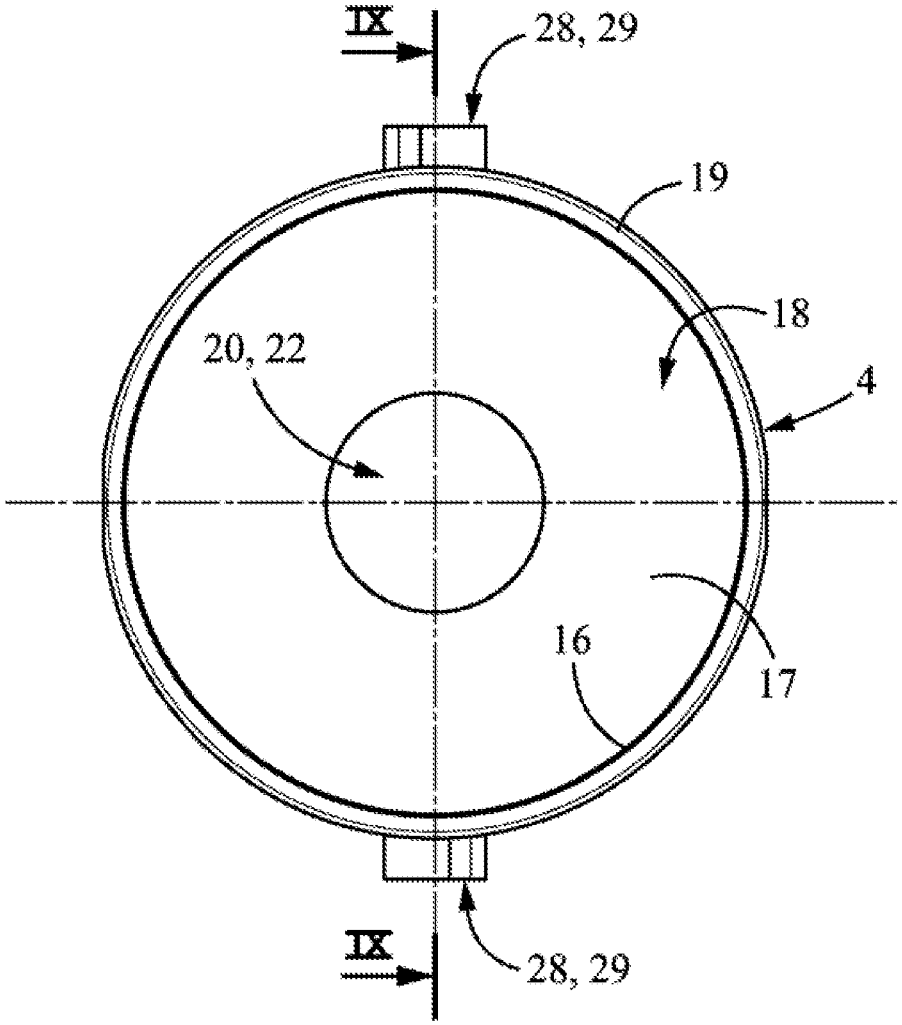
FIG. 8 is a top view of the outer cup of FIGS. 5 and 6.
Figure 9:
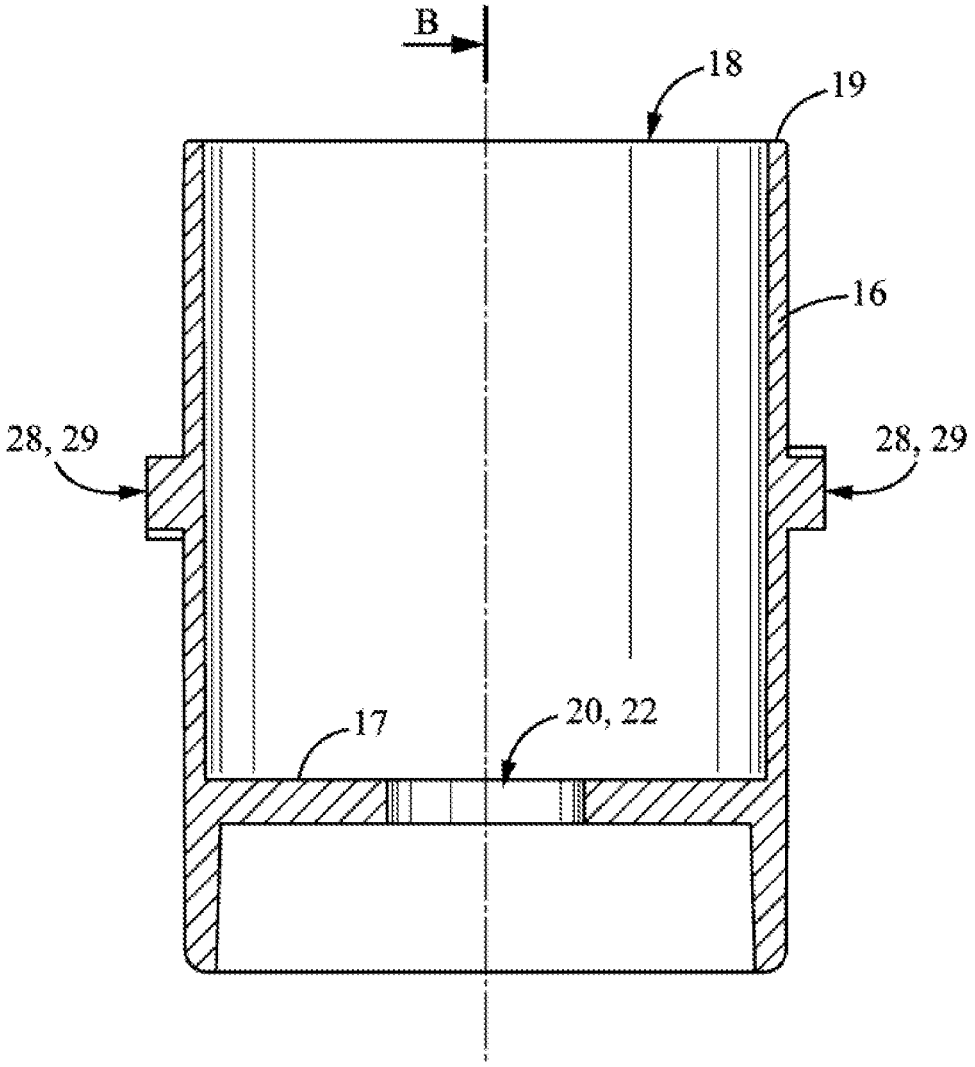
FIG. 9 is a sectional view along axis IX-IX of the outer cup of FIG. 8.
Figure 10:
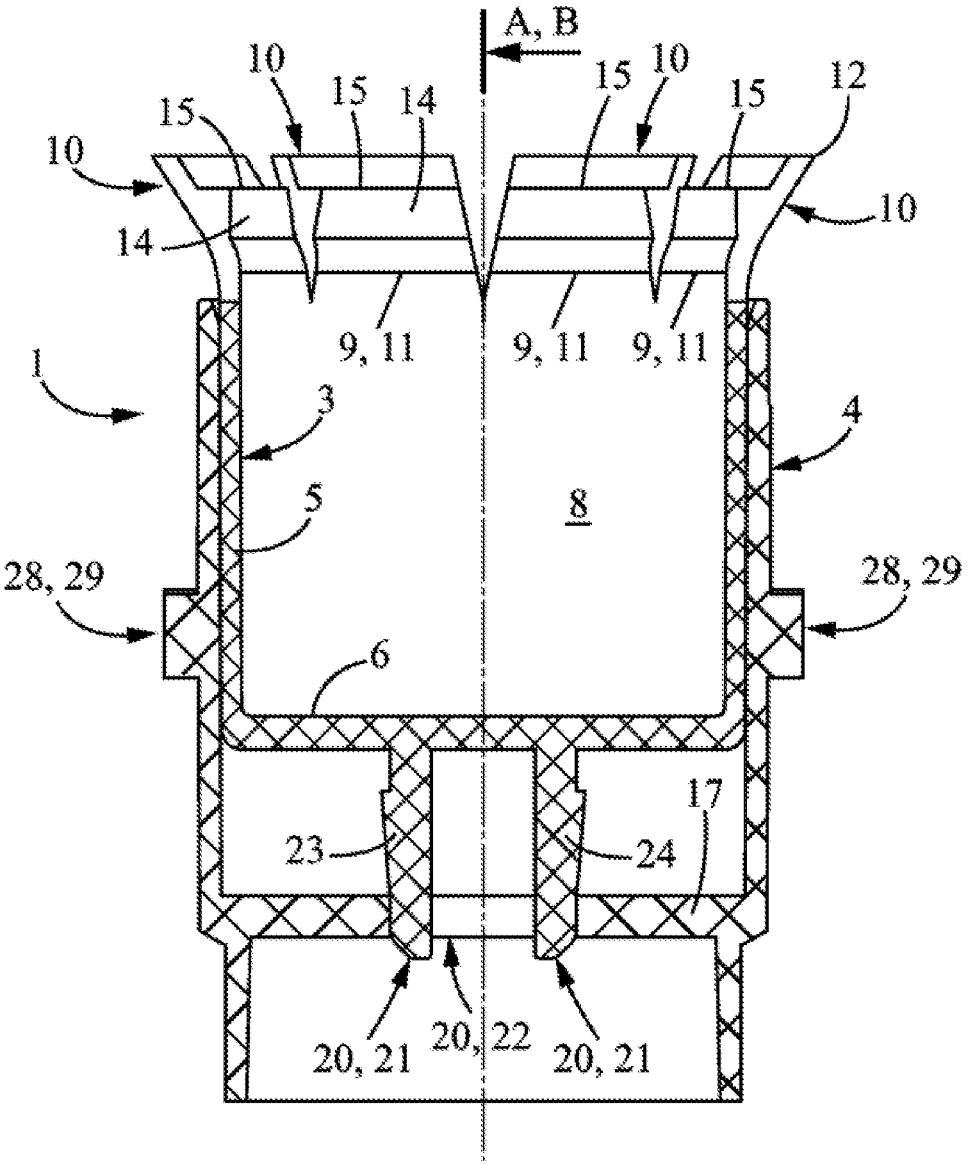
FIG. 10 is a sectional view of the retaining system, representing the inner cup of FIGS. 1 to 4 and the outer cup of FIGS. 6 to 9 in a pre-assembled position with the claws in the open position.
Figure 11:
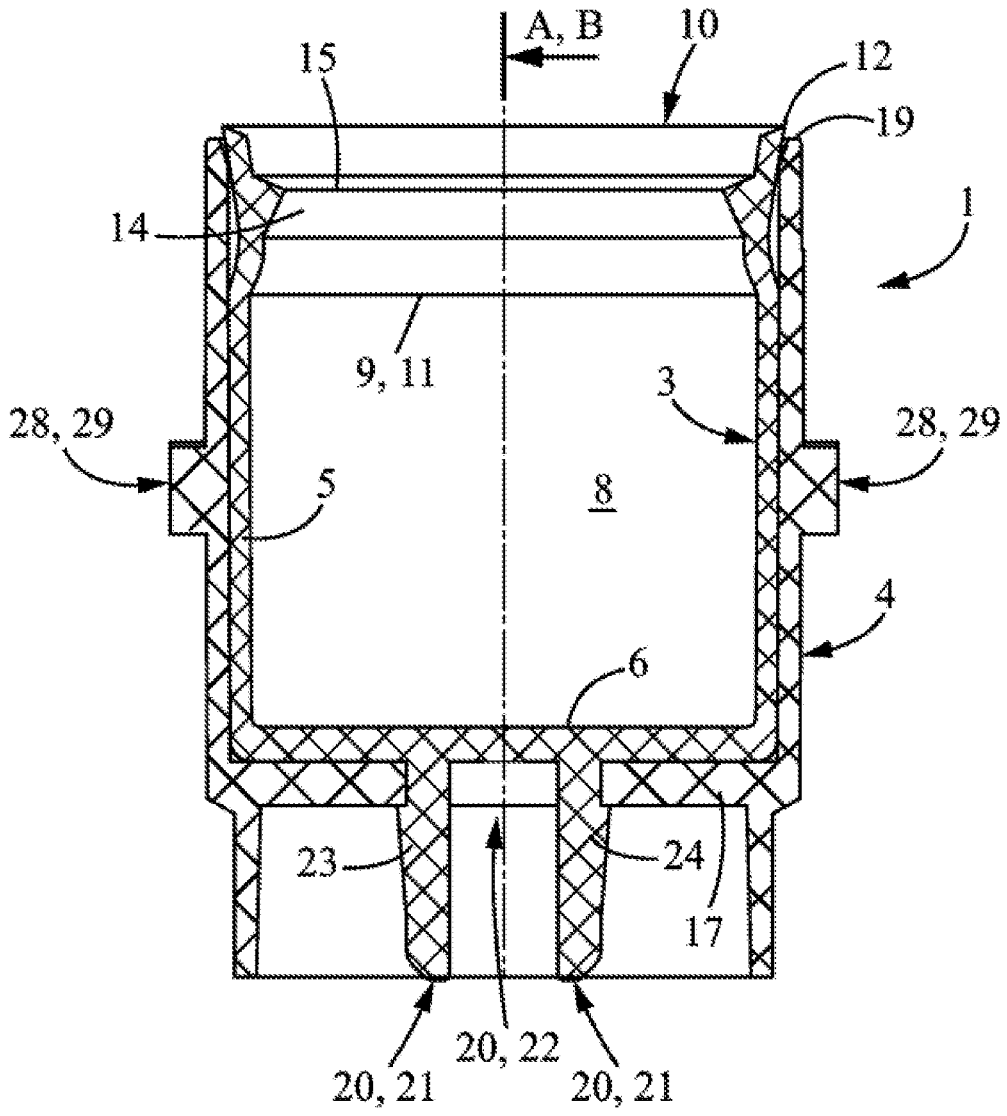
FIG. 11 is a sectional view of the retaining system similar to that of FIG. 10, with the inner cup and outer cup in an assembled position and the claws in a locking position.

According to a first embodiment, the locking elements 20 are formed on the bottoms 6, 17 of the cups 3, 4. The locking elements 20 comprise at least one tab 21 projecting from the outer surface of the bottom 6 of the inner cup 3 and at least one hole 22 in the bottom 17 of the outer cup 4. The tab 21 and hole 22 snap-fit together, so that when the inner cup 3 is forcibly inserted into the outer cup 4, and the claws move to the locking position, the tab 21 is simultaneously inserted into the hole 22 where it snap-fits to lock it in place. According to one embodiment, which is illustrated in particular in FIGS. 1 to 11, the hole 22 is substantially circular and central in the bottom 17 of the outer cup 4. The inner cup 3 comprises two tabs 21, each forming a portion of the same cylinder. At least one bead 23, 24 as represented in FIGS. 10 and 11, or two beads as illustrated in FIGS. 1, 2, and 4, is formed on each tab 21, having dimensions adapted to those of the hole 22 in order to achieve the snap-fitting effect. When the tabs 21 are inserted by force into the hole 22, the beads 23, 24 thus force the tabs 21 to flex slightly towards each other. The beads 23, 24 enter the hole 22 and then, once they pass beyond it, the tabs 21 return to their initial position. The bottom 17 of the inner cup 4 is then trapped between the beads 23, 24 of the tabs 21 and the bottom 6 of the inner cup 3.

Figure 12:
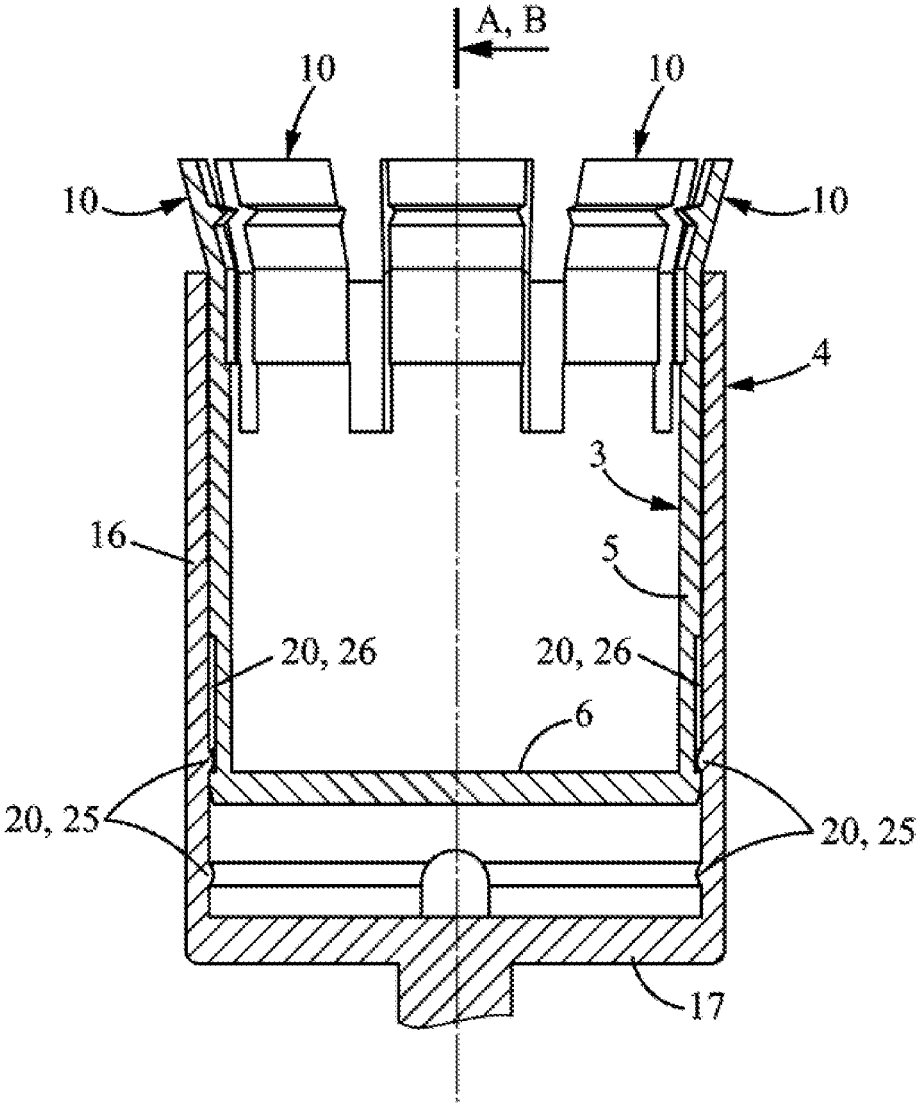
FIG. 12 is a sectional view of a variant of the retaining system.
Figure 13:
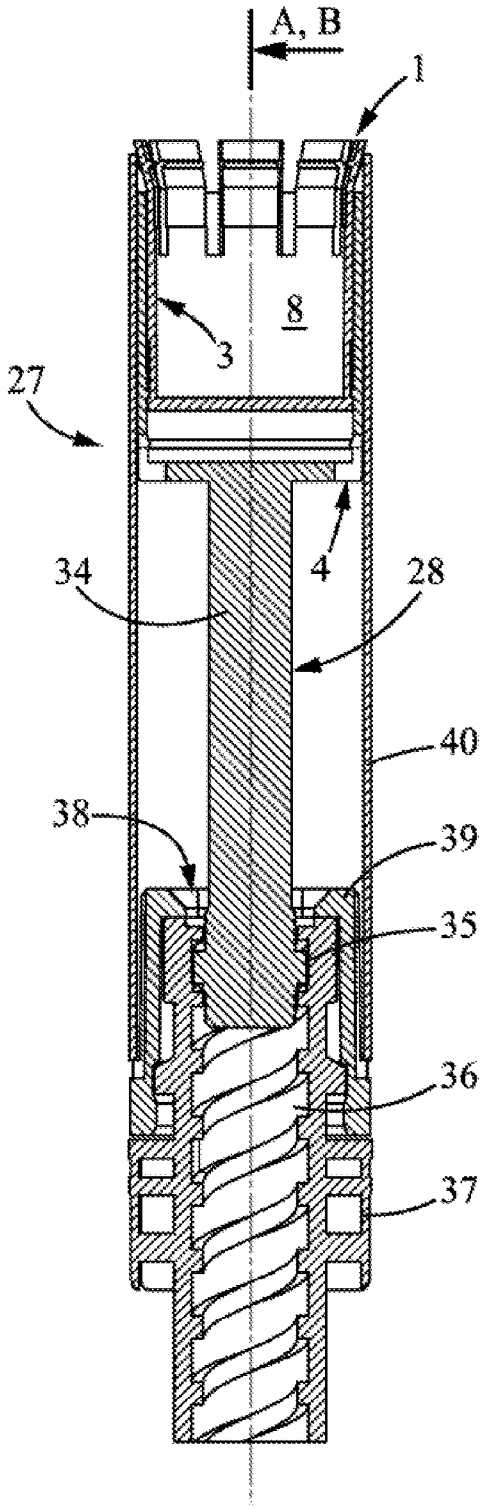
FIG. 13 is a sectional view of the retaining system of FIG. 12 in cooperation with a casing.
Figure 14:
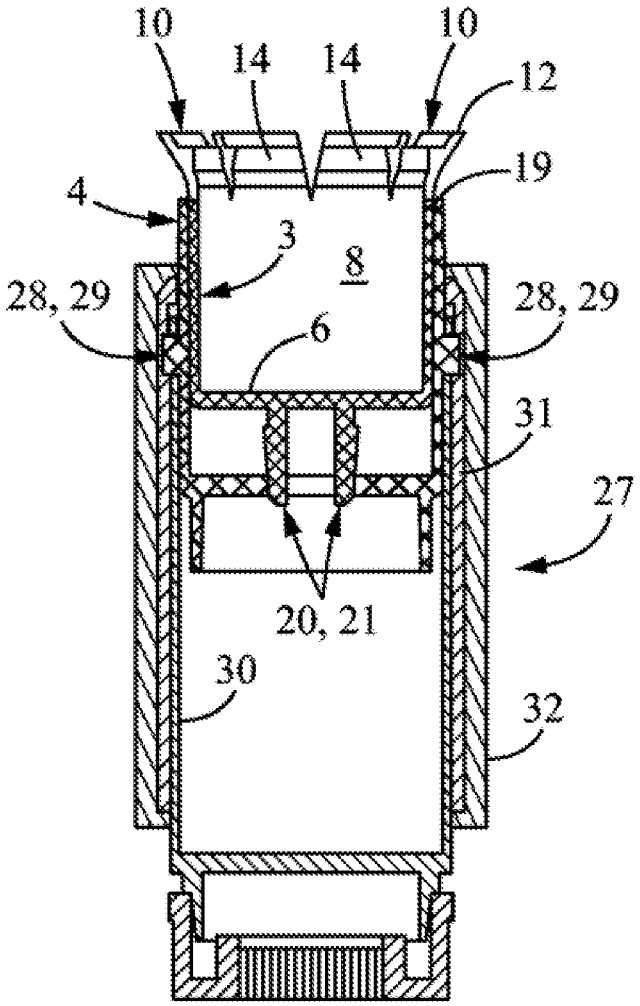
FIGS. 14 to 16 schematically represent a lipstick casing provided with a retaining system according to the previous figures, in three successive steps of a method for assembling a stick of lipstick in the casing.
Figure 15:
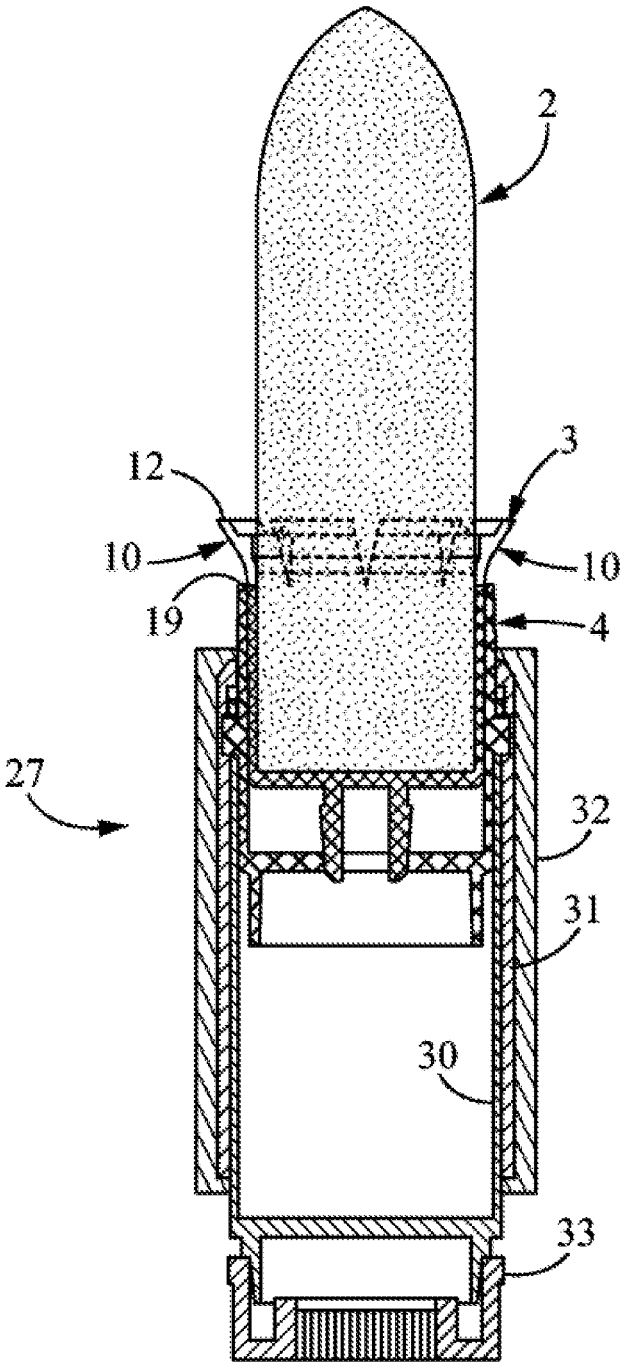
Figure 16:
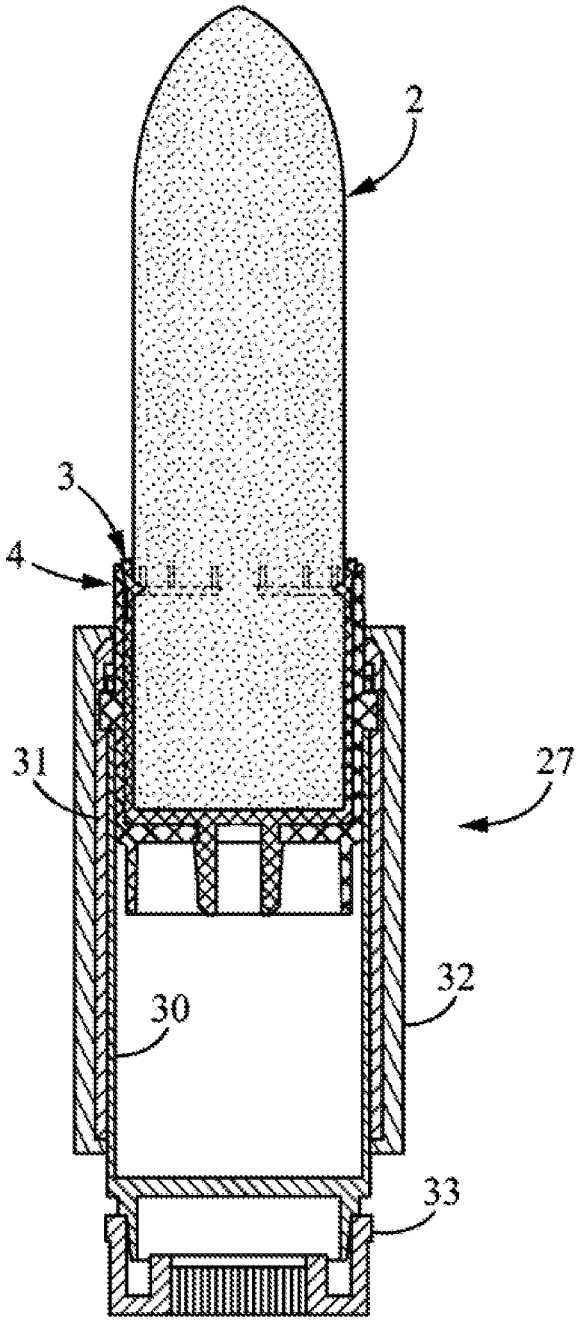

According to a second embodiment, illustrated in particular in FIGS. 12 and 13, the locking elements 20 are formed on the side walls 5, 16 of the cups 3, 4. The locking elements 20 comprise at least one annular bead 25, two beads 25 in the example of FIGS. 12 and 13, projecting from the inner surface of the side wall 16 of the outer cup 4, and at least one annular recess 26 formed on the outer surface of the side wall 5 of the inner cup 3. The beads 25 and the recess 26 snap-fit together. Specifically, upon insertion of the outer cup 3 into the inner cup 4, the beads 25 slide along the outer surface of the side wall 5 of the inner cup 3, forcing the side wall 5 of the inner cup 3 and/or the side wall 16 of the outer cup 4 to deform slightly. The beads 25 reach the recess 26 substantially at the same moment as the claws have moved to the locking position. The beads 25 thus enter the recess 26, the side walls 5, 16 resuming their initial position. The dimensions of the beads 25 and the recess 26 are such that the inner cup 3 is then locked, at least along the longitudinal axis A, with respect to the outer cup 4.

The retaining system 1 is intended to be mounted in a casing 27, in particular for lipstick, for which the retaining system 1 also forms a support for the stick 4.

To this end, the outer cup 4 is sized to be mounted so as to be slidable along the longitudinal axis A within the casing 27 and comprises guide elements 28 in the casing 27.

According to a first embodiment, the guide elements 28 are formed on the outer surface of the side wall 16 of the outer cup 4 and comprise at least one lug 29 projecting from the outer surface of the side wall 16 of the outer cup 4. In practice, the outer cup 4 is provided with two diametrically opposed lugs 29. The casing 27 then comprises an inner body 30 on which are formed two slots extending along the longitudinal axis A. A shell 31 provided with two helical grooves is fitted onto the inner body 30. The lugs 29 of the inner cup 4 are each placed in a slot and a helical groove. An outer sleeve 32, to which the shell 31 is fixed, surrounds the whole. A mechanism 33 for actuating the inner body 30, accessible for example on a lower portion of the casing 27, allows rotating the inner body 30 with respect to the shell 31 and thus causes displacement of the outer cup 4, inner cup 3, and stick 2, within the casing 27, in the direction of the longitudinal axis A, due to the helical connection of the lugs 29 on the casing 27.

This first embodiment of the guide elements 28 is advantageously combined with the first embodiment of the locking elements 20 for locking the inner cup 3 in the outer cup 4, on the bottoms 6, 17.

According to a second embodiment, the guide elements 28 are formed on the bottom 17 of the outer cup 4. To this end, the outer cup 4 comprises a guide rod 34, extending from the outer surface of the bottom 17 along the longitudinal axis B of the outer cup 4. The guide rod 34 has a non-symmetrical cross-section, and is provided at its free end with at least one fin 35 projecting perpendicularly to the longitudinal axis B, in practice two fins 35, each being adapted to cooperate with a helical groove 36 of a shell 37 of the casing 27. The guide rod 34 is inserted into a non-symmetrical slot 38 of a guide 39 of the casing 27, preventing relative rotation between guide rod 34 and guide 39. The assembly is placed in an outer sleeve 40. Thus, by actuating the rotation of the shell 37, via a mechanism accessible to a user (not shown in the figures), the fins 35 slide in the grooves 36, causing translation of the guide rod 34 and outer cup 4 in the casing 27 along the longitudinal axis A, due to the helical connection of the guide rod 34 on the casing 27.

This second embodiment of the guide elements 28 is advantageously combined with the second embodiment of the locking elements 20 for locking the inner cup 3 in the outer cup 4, on the side walls 5, 16.

The assembly of the stick 2 in the casing 27 can then be carried out as follows.

The outer cup 4 is first inserted into the casing 27, so that the guide elements are installed 28 in the casing 27.

The inner cup 3 is inserted into the outer cup 4, the claws 10 remaining in the open position. More specifically, the claws 10 are in abutment against the edge 19 of the opening 18 of the outer cup 4.

Next the stick 2 is inserted into the housing 8 formed by the inner cup 3, until it abuts against the bottom 6 of the inner cup 3.

Force is then applied to the stick 2 along the longitudinal axis A and transmitted to the inner cup 3. The claws 10 are then forced to move beyond the edge 19 of the outer cup 4 and to flex toward the inside of the housing 8, where the stick 2 is located. The claws 10 are then in the locking position, and penetrate the stick 2. The material of the stick 2 is now all around the claws 10 and the slots 13. The claws are anchored in the stick 2, which can no longer move, both in translation along the longitudinal axis and in rotation about the same axis.

The claws 10, by biting into the stick 2, exert a force on the stick 2 along the longitudinal axis A which tends to hold the stick 2 against the bottom of the inner cup 3.

The assembly of the stick is then particularly simple, with a single movement of insertion of the stick 2 into the retaining system 1 and casing 27. The result is an optimal locking, the material of the stick coming through the slots 13 to surround each claw 10, preventing any movement between the stick 2 and the retaining system 1.

The association of inner cup 3 and outer cup 4 provides in particular a secure and effective retention of the stick 2 in its support formed by the retaining system 1.

In particular, when the retaining system 1 is extended as far as possible out of the casing 27, the claws 10 are still firmly anchored in the stick 2 due to the outer cup 4 being locked to the inner cup 3 and continuously exerting force on the claws 10 which retains them in the locking position, decreasing the risk of the stick unintentionally escaping.

The retaining system 1 is inexpensive.

The inner cup 3 and outer cup 4 are, for example, obtained by molding thermoplastic material. To facilitate the bending of claws 10 in order to shift to the locking position, the outer cup 4 is preferably formed of a material harder than that of the inner cup 3.

The retaining system 1 can be adapted to any type of case. In particular, the guide elements 28 with the casing 27 can be placed on the bottom 17 of the outer cup 3 or on its side wall 16. Thus, the described retaining system 1 does not require developing new parts for the casing, as existing casings are able to integrate the retaining system 1.

The invention claimed is:

1. A retaining system for retaining a cosmetic product in the form of a stick of material, in particular a stick of lipstick, in a casing, wherein the system comprises an inner cup forming a housing for the stick, the inner cup comprising an opening through which the stick can be inserted, an edge of the opening being provided with a plurality of at least partially flexible claws, arranged in a crown extending between a proximal boundary edge, of dimensions greater than or equal to dimensions of the edge of the opening, and a distal boundary edge, the claws being able to take two positions:

i) an open position, in which dimensions of the distal boundary edge are greater than or equal to the dimensions of the edge of the opening, the claws allowing insertion of the stick into the inner cup, and ii) a locking position, in which the dimensions of the distal boundary edge are less than the dimensions of the edge of the opening, the claws being able to penetrate into the stick previously inserted into the inner cup in order to lock said stick;

the system further comprising an outer cup, adapted to be slidably mounted in the casing, and forming a sleeve for the inner cup, sleeve dimensions being adapted to allow the crown of claws to shift from the open position to the closed position by insertion of the inner cup into the outer cup, and elements for locking the inner cup in the outer cup when the claws are in locking position, wherein said locking elements comprise at least one tab projecting from an outer surface of a bottom of the inner cup and at least one hole in a bottom of the outer cup, the tab and hole snap-fitting together to lock the inner cup in the outer cup when the crown of claws is in the locking position.

2. The retaining system according to claim 1, wherein the outer cup comprises, on the outer surface of a side wall, at least one lug adapted to be in helical connection with the casing so as to guide the sliding of the outer cup in the casing.

3. The retaining system according to claim 1, wherein the outer cup comprises, on its bottom, a guide rod provided with at least one fin adapted to be in helical connection with the casing.

4. The retaining system according to claim 1, wherein the claws each have an inner side facing the housing for the stick, the inner side of the claws being provided with teeth.

5. The retaining system according to claim 1, wherein the claws are identical to one another and are four to ten in number, regularly distributed around the opening of the inner cup.

6. A casing of a stick of material for a cosmetic product, provided with a retaining system according to claim 1, the outer cup cooperating in translation with the casing so as to cause the stick to extend from the casing or retract into the casing.

7. A method for assembling a stick of material for a cosmetic product in a casing according to claim 6, wherein the method comprises the following operations:

insertion of the outer cup into the casing, insertion of the inner cup into the outer cup, the claws being in the open position, insertion of the stick into the housing of the inner cup, application of force on the stick so as to force the crown of claws of the inner cup into the outer cup, the claws coming into the locking position, and engaging the locking elements between the inner cup and outer cup.

8. A retaining system for retaining a cosmetic product in the form of a stick of material, in particular a stick of lipstick, in a casing, wherein the system comprises an inner cup forming a housing for the stick, the inner cup comprising an opening through which the stick can be inserted, an edge of the opening being provided with a plurality of at least partially flexible claws, arranged in a crown extending between a proximal boundary edge, of dimensions greater than or equal to dimensions of the edge of the opening, and a distal boundary edge, the claws being able to take two positions:

i) an open position, in which dimensions of the distal boundary edge are greater than or equal to the dimensions of the edge of the opening, the claws allowing insertion of the stick into the inner cup, and ii) a locking position, in which the dimensions of the distal boundary edge are less than the dimensions of the edge of the opening, the claws being able to penetrate into the stick previously inserted into the inner cup in order to lock said stick;

the system further comprising an outer cup, adapted to be slidably mounted in the casing, and forming a sleeve for the inner cup, sleeve dimensions being adapted to allow the crown of claws to shift from the open position to the closed position by insertion of the inner cup into the outer cup, in that it comprises elements for locking the inner cup in the outer cup when the claws are in locking position, wherein said locking elements comprise at least one bead projecting from an inner surface of a side wall of the outer cup and at least one recess in an outer surface of a side wall of the inner cup, the bead and recess snap-fitting together to lock the inner cup in the outer cup when the claws are in the locking position.

9. The retaining system according to claim 8, wherein the outer cup comprises, on the outer surface of a side wall, at least one lug adapted to be in helical connection with the casing so as to guide the sliding of the outer cup in the casing.

10. The retaining system according to claim 8, wherein the outer cup comprises, on its bottom, a guide rod provided with at least one fin adapted to be in helical connection with the casing.

11. The retaining system according to claim 8, wherein the claws each have an inner side facing the housing for the stick, the inner side of the claws being provided with teeth.

12. The retaining system according to claim 8, wherein the claws are identical to one another and are four to ten in number, regularly distributed around the opening of the inner cup.

13. A casing of a stick of material for a cosmetic product, provided with a retaining system according to claim 8, the outer cup cooperating in translation with the casing so as cause the stick to extend from the casing or retract into the casing.

14. The method for assembling a stick of material for a cosmetic product in a casing according to claim 13, wherein the method comprises the following operations:

insertion of the outer cup into the casing, insertion of the inner cup into the outer cup, the claws being in the open position, insertion of the stick into the housing of the inner cup, application of force on the stick so as to force the crown of claws of the inner cup into the outer cup, the claws coming into the locking position, and engaging the locking elements between the inner cup and outer cup.

15. A casing of a stick of material for a cosmetic product, provided with a retaining system for retaining a cosmetic product in the form of a stick of material, in particular a stick of lipstick, in the casing, wherein the system comprises an inner cup forming a housing for the stick, the inner cup comprising an opening through which the stick can be inserted, an edge of the opening being provided with a plurality of at least partially flexible claws, arranged in a crown extending between a proximal boundary edge, of dimensions greater than or equal to dimensions of the edge of the opening, and a distal boundary edge, the claws being able to take two positions:

i) an open position, in which dimensions of the distal boundary edge are greater than or equal to the dimensions of the edge of the opening, the claws allowing insertion of the stick into the inner cup, and ii) a locking position, in which the dimensions of the distal boundary edge are less than the dimensions of the edge of the opening, the claws being able to penetrate into the stick previously inserted into the inner cup in order to lock said stick;

the system of the casing further comprising an outer cup, adapted to be slidably mounted in the casing, and forming a sleeve for the inner cup, sleeve dimensions being adapted to allow the crown of claws to shift from the open position to the closed position by insertion of the inner cup into the outer cup, and elements for locking the inner cup in the outer cup when the claws are in locking position, wherein the outer cup cooperates in translation with the casing so as cause the stick to extend from the casing or retract into the casing.

16. The casing according to claim 15, wherein the outer cup comprises, on the outer surface of a side wall, at least one lug adapted to be in helical connection with the casing so as to guide the sliding of the outer cup in the casing.

17. The casing according to claim 15, wherein the outer cup comprises, on its bottom, a guide rod provided with at least one fin adapted to be in helical connection with the casing.

18. The casing according to claim 15, wherein the locking elements comprise at least one tab projecting from an outer surface of a bottom of the inner cup and at least one hole in a bottom of the outer cup, the tab and hole snap-fitting together to lock the inner cup in the outer cup when the crown of claws is in the locking position.

19. The casing according to claim 15, wherein the locking elements comprise at least one bead projecting from an inner surface of a side wall of the outer cup and at least one recess in an outer surface of a side wall of the inner cup, the bead and recess snap-fitting together to lock the inner cup in the outer cup when the claws are in the locking position.

20. The casing according to claim 15, wherein the claws each have an inner side facing the housing for the stick, the inner side of the claws being provided with teeth.

21. The casing according to claim 15, wherein the claws are identical to one another and are four to ten in number, regularly distributed around the opening of the inner cup.

22. A method for assembling a stick of material for a cosmetic product in a casing according to claim 15, wherein the method comprises the following operations:

insertion of the outer cup into the casing, insertion of the inner cup into the outer cup, the claws being in the open position, insertion of the stick into the housing of the inner cup, application of force on the stick so as to force the crown of claws of the inner cup into the outer cup, the claws coming into the locking position, and engaging the locking elements between the inner cup and outer cup.

* * * * *